US010100441B2

(12) United States Patent
Suzuki et al.

(10) Patent No.: US 10,100,441 B2
(45) Date of Patent: Oct. 16, 2018

(54) THERMAL BONDING CONJUGATE FIBER AND NONWOVEN FABRIC USING THE SAME

(75) Inventors: Tomoaki Suzuki, Osaka (JP); Shingo Horiuchi, Osaka (JP)

(73) Assignees: ES FiberVisions CO., LTD., Osaka-shi, Osaka (JP); ES FiberVisions Hong Kong Limited, Kowloon, Hong Kong (CN); ES FiberVisions LP, Athens, GA (US); ES FiberVisions ApS, Varde (DK)

( * ) Notice: Subject to any disclaimer, the term of this patent is extended or adjusted under 35 U.S.C. 154(b) by 0 days.

(21) Appl. No.: 13/392,314

(22) PCT Filed: Aug. 27, 2010

(86) PCT No.: PCT/JP2010/065081

§ 371 (c)(1),
(2), (4) Date: Apr. 3, 2012

(87) PCT Pub. No.: WO2011/025062

PCT Pub. Date: Mar. 3, 2011

(65) Prior Publication Data

US 2012/0184168 A1 Jul. 19, 2012

(30) Foreign Application Priority Data

Aug. 27, 2009 (JP) ..... 2009-196796

(51) Int. Cl.

| | |
|---|---|
| ***D02G 3/04*** | (2006.01) |
| ***D01F 8/14*** | (2006.01) |
| ***D01F 8/06*** | (2006.01) |
| ***D04H 1/541*** | (2012.01) |
| ***D01D 5/12*** | (2006.01) |
| ***D01D 5/22*** | (2006.01) |
| ***D01D 5/34*** | (2006.01) |
| ***D04H 1/74*** | (2006.01) |

(52) U.S. Cl.

CPC ..... *D01F 8/14* (2013.01); *D01D 5/12* (2013.01); *D01D 5/22* (2013.01); *D01D 5/34* (2013.01); *D01F 8/06* (2013.01); *D04H 1/541* (2013.01); *D04H 1/74* (2013.01); *Y10T 428/2931* (2015.01); *Y10T 442/641* (2015.04)

(58) Field of Classification Search

None

See application file for complete search history.

(56) References Cited

U.S. PATENT DOCUMENTS

| | | | | | |
|---|---|---|---|---|---|
| 3,616,184 | A | * | 10/1971 | Katagiri | C08K 3/22 428/372 |
| 4,551,378 | A | * | 11/1985 | Carey, Jr. | 428/198 |
| 4,552,603 | A | | 11/1985 | Harris, Jr. et al. | |
| 5,227,224 | A | * | 7/1993 | Ishikawa et al. | 428/212 |
| 5,456,982 | A | | 10/1995 | Hansen et al. | |
| 7,670,677 | B2 | * | 3/2010 | Usui et al. | 428/374 |
| 2005/0093197 | A1 | | 5/2005 | Dahringer et al. | |
| 2010/0143717 | A1 | | 6/2010 | Sakamoto et al. | |

FOREIGN PATENT DOCUMENTS

| | | | |
|---|---|---|---|
| JP | 01-298206 | | 12/1989 |
| JP | 02-145811 | | 6/1990 |
| JP | 2908454 | | 4/1999 |
| JP | 2000-336526 | | 12/2000 |
| JP | 2001-011763 | | 1/2001 |
| JP | 2006-233381 | | 9/2006 |
| JP | H02169718 | * | 9/2006 |
| JP | 2007-126806 | | 5/2007 |
| JP | 2008-248421 | | 10/2008 |
| JP | 2010-059585 | | 3/2010 |
| WO | 2008/133348 | | 11/2008 |

OTHER PUBLICATIONS

Machine translation of JP 2006-233381 Usui et al.*
Machine translation of Abstract of JPH02169718, Matsuo et al. Sep. 2006.*

* cited by examiner

*Primary Examiner* — Shawn Mckinnon
(74) *Attorney, Agent, or Firm* — Hamre, Schumann, Mueller & Larson, P.C.

(57) ABSTRACT

This invention provides a thermal bonding conjugate fiber having excellent compression resistance and nonwoven fabric using the same. Particularly, the nonwoven fabric retains bulkiness obtained under a light load even under a heavy load and reduces a decrease in bulkiness from under a light load to under a heavy load. The thermal bonding conjugate fiber has an eccentric core-sheath structure in which a first component including a polyester resin constitutes a core and a second component including a polyolefin resin having a melting point at least 15° C. lower than that of the polyester resin constitutes a sheath, and a shrinkage ratio of the conjugate fiber after a heat treatment of 120° C. is at least 20%. The nonwoven fabric is obtained by blending the thermal bonding conjugate fiber at a blend ratio of 10 to 60 wt % with one or more types of different thermal bonding fibers.

5 Claims, No Drawings

THERMAL BONDING CONJUGATE FIBER AND NONWOVEN FABRIC USING THE SAME

TECHNICAL FIELD

The present invention relates to a thermal bonding conjugate fiber, and more specifically to a thermal bonding conjugate fiber with thermal shrinkage properties. The present invention also relates to a nonwoven fabric with excellent compression resistance prepared using the thermal bonding conjugate fiber.

BACKGROUND ART

In the past thermal bonding conjugate fibers that can be formed by thermal fusion bonding using heat energy from hot air, heating rollers, and the like have been widely used for hygiene products such as diapers, napkins, and pads, or for articles used in daily life and industrial materials such as filters because bulkiness can easily be obtained thereby. In particular, hygiene articles must be soft and feel comfortable because they are items in direct contact with the skin, and they must be absorbent because liquids such as urine and menstrual flow must be absorbed quickly. Many methods have been proposed for obtaining a fiber and nonwoven fabric that has bulkiness capable of expressing such performance.

Several items with improved recovery from compression have been proposed in the prior art. In Patent document 1, for example, elasticity is imparted to the fiber by using a thermoplastic elastomer, and recovery from compression is improved thereby. However, the use of a thermoplastic elastomer is essential in this method, and it is difficult to use the same in a hygiene product directly in contact with the skin because of the characteristic sticky feeling of the elastomer. In Patent document 2, although recovery from compression is improved by generating latent crimping in a side-by-side configuration, the combinations of resins with good compatibility for maintaining the fiber cross-section in a side-by-side configuration are limited in that method. Moreover, such prior art involves methods that improve recovery from compression, but there are almost no methods that improve compression resistance, i.e., methods that reduce the rate of decrease in bulkiness between under a light load and under a heavy load.

[Patent document 1] Japanese Patent Application Publication No. 2001-11763

[Patent document 2] Japanese Patent No. 2908454

DISCLOSURE OF THE INVENTION

Therefore, an object of the present invention is to provide a thermal bonding conjugate fiber with excellent compression resistance and a nonwoven fabric using the same. A further object of the present invention is to provide a thermal bonding conjugate fiber with excellent compression resistance and a nonwoven fabric using the same wherein the bulkiness of the nonwoven fabric under a light load can be retained better under a heavy load, and the rate of decrease in bulkiness between under a light load and under a heavy load can be reduced.

The inventors conducted intensive research to overcome the above problems, and they discovered that the above problems can be solved by manufacturing a thermal bonding conjugate fiber having a thermal shrinkage ratio of a set value or greater, and by using that thermal bonding conjugate fiber as a raw material for a nonwoven fabric in a set ratio.

More specifically, the present invention has the following features:

(1) A thermal bonding conjugate fiber with thermal shrinkage properties, having an eccentric core-sheath structure in which a first component comprising a polyester resin constitutes a core and a second component comprising a polyolefin resin having a melting point at least 15° C. lower than a melting point of the polyester resin constitutes a sheath, wherein a shrinkage ratio after a heat treatment of 120° C. is at least 20% when calculated by the following measurement method:

$$\text{shrinkage ratio}(\%)=\{(25\ (\text{cm})-h1\ (\text{cm}))/25\ (\text{cm})\}\times 100$$

(wherein h1 represents the shorter of either lengthwise dimension or crosswise dimension of the web after giving a heat treatment for 5 minutes to a 25 cm×25 cm web having a mass per unit area of 200 g/m$^2$).

(2) The thermal bonding conjugate fiber according to (1) above wherein the preferred modes of the above thermal bonding conjugate fiber have a shrinkage ratio after a heat treatment of 100° C., 120° C., and 145° C. calculated by the above measurement method that satisfies the following two expressions:

$$\text{shrinkage ratio at } 120^\circ\text{ C.} \geq \text{shrinkage ratio at } 145^\circ\text{ C.; and}$$

$$\text{shrinkage ratio at } 120^\circ\text{ C.} \geq \text{shrinkage ratio at } 100^\circ\text{ C.}$$

(3) The thermal bonding conjugate fiber according to (1) or (2) above wherein a fineness of the thermal bonding conjugate fiber is from 1.0 to 8.0 dtex.

(4) A nonwoven fabric, in which the thermal bonding conjugate fiber of any of (1) to (3) above is blended with one or more types of a different thermal bonding fiber, and the thermal bonding conjugate fiber of any of (1) to (3) above is contained therein at a blend ratio of 10 to 60 wt %.

The thermal bonding conjugate fiber of the present invention has a measured thermal shrinkage ratio when processed into a web that lies within a set range, and in a nonwoven fabric manufactured using that thermal bonding conjugate fiber the bulkiness under a light load is retained even better under a heavy load, and the rate of decrease in bulkiness between under a light load and under a heavy load is reduced. More specifically, the thermal bonding conjugate fiber of the present invention can provide a nonwoven fabric with excellent compression resistance. By also adding inorganic fine particles to the thermal bonding conjugate fiber of the present invention, a more excellent nonwoven fabric that simultaneously combines bulkiness, compression resistance, and softness can be obtained.

MODE FOR CARRYING OUT THE INVENTION

The present invention is described in greater detail below.

The conjugate fiber of the present invention consists of a thermoplastic resin, and is a conjugate fiber having an eccentric core-sheath structure wherein a first component comprising a polyester resin constitutes the core and a second component comprising a polyolefin resin having a melting point at least 15° C. lower than the melting point of the above polyester resin constitutes the sheath.

The polyester resin constituting the core of the thermal bonding conjugate fiber of the present invention (also simply referred to as the conjugate fiber below) can be obtained by condensation polymerization of a diol and a dicarboxylic acid. Examples of the dicarboxylic acid used in the condensation polymerization of the polyester include terephthalic acid, isoterephthalic acid, 2,6-naphthalene dicarboxylic acid, adipic acid, sebacic acid, and the like. Examples of the diol used include ethylene glycol, diethylene glycol, 1,3-propane diol, 1,4-butane diol, neopentyl glycol, 1,4-cyclohexane dimethanol, and the like.

Polyethylene terephthalate, polypropylene terephthalate, and polybutylene terephthalate are preferably used as the polyester resin in the present invention. In addition to the above aromatic polyesters, an aliphatic polyester can also be used, and examples of preferred resins include polylactic acid and polybutylene adipate terephthalate. These polyester resins may be used not only as a simple polymer, but as a copolymer polyester (co-polyester). In such a case, a dicarboxylic acid such as adipic acid, sebacic acid, phthalic acid, isophthalic acid, 2,6-naphthalene dicarboxylic acid and the like; a diol such as diethylene glycol, neopentyl glycol and the like; or an optical isomer such as L-lactic acid and the like can be used as a copolymer component thereof. In addition, two or more types of these polyester resins may be mixed and used together. When the raw material cost and thermal stability of the resulting fiber are taken into consideration, an unmodified polymer consisting only of polyethylene terephthalate is the most preferred.

A high density polyethylene, linear low density polyethylene, low density polyethylene, polypropylene (propylene homopolymer), ethylene-propylene copolymer having propylene as the main component thereof, ethylene-propylene-butene-1 copolymer having propylene as the main component thereof, polybutene-1, polyhexene-1, polyoctene-1, poly 4-methyl pentene-1, polymethyl pentene, 1,2-polybutadiene, and 1,4-polybutadiene can be used as the polyolefin resin constituting the sheath of the thermal bonding conjugate fiber of the present invention.

Furthermore, a small amount of α-olefin such as ethylene, butane-1, hexene-1, octane-1 or 4-methyl pentene-1 and the like may be included in these homopolymers as a copolymer component in addition to the monomer constituting the homopolymer. Moreover, a small amount of another ethylene series unsaturated monomer such as butadiene, isoprene, 1,3-pentadiene, styrene, α-methyl styrene and the like may be included as a copolymer component. Additionally, 2 or more types of the aforementioned polyolefin resins may be mixed together and used. Not only polyolefin resins polymerized by a conventional Ziegler-Natta catalyst, but also polyolefin resins polymerized by a metallocene catalyst and copolymers thereof can be preferably used therefor. Finally, the melt flow rate (hereinafter, MFR) of a polyolefin resin that can be most suitably used is not particularly limited in the present invention provided it lies within the spinnable range, but an MFR of 1 to 100 g/10 min is preferred, and 5 to 70 g/10 min is more preferred.

The present invention does not limit the properties of the polyolefin resin other than the aforementioned MFR, e.g., the Q value (weight average molecular weight/number average molecular weight), Rockwell hardness, number of branching methyl chains, and the like provided the requirements of the present invention are satisfied thereby.

Examples of the combination of the first component/second component of the present invention include the following: polyethylene terephthalate/polypropylene, polyethylene terephthalate/high density polyethylene, polyethylene terephthalate/linear low density polyethylene, polyethylene terephthalate/low density polyethylene, etc. Among these the preferred combination is polyethylene terephthalate/high density polyethylene. Other than polyethylene terephthalate, polybutylene terephthalate, polytrimethylene terephthalate, and polylactate can also be used.

Additives such as an antioxidant, photostabilizing agent, UV absorbing agent, neutralizing agent, nucleating agent, epoxy stabilizer, lubricant, antibacterial agent, flame retardant, antistatic agent, pigment, plasticizer, and the like may be added to the thermoplastic resin used in the present invention as needed within a range that does not interfere with the effect of the present invention.

In addition, inorganic fine particles can be added to the conjugate fiber of the present invention as needed within a range that does not interfere with the advantageous effect thereof to impart a drape feeling originating in its own weight and a smoothness to the touch, and to obtain a fiber with excellent softness due to the formation of spaces such as voids and cracks within and without. The preferred range of the inorganic particles in the conjugate fiber is preferably 0 to 10 wt %, and more preferably 1 to 5 wt %.

The above inorganic fine particles are not particularly limited herein provided they have a high specific gravity and they will not easily agglomerate in the molten resin. Examples include titanium oxide (specific gravity 3.7 to 4.3), zinc oxide (specific gravity 5.2 to 5.7), barium titanate (specific gravity 5.5 to 5.6), barium carbonate (specific gravity 4.3 to 4.4), barium sulfate (specific gravity 4.2 to 4.6), zirconium oxide (specific gravity 5.5), zirconium silicate (specific gravity 4.7), alumina (specific gravity 3.7 to 3.9), magnesium oxide (specific gravity 3.2) or an inorganic fine particle having roughly the same specific gravity, and among these titanium oxide is preferred. The addition and use of these inorganic fine particles to fibers for their concealment properties, antimicrobial properties, deodorant properties, etc., is generally well known. As a matter of course, the inorganic fine particles to be used will be of a size and shape that do not cause problems such as yarn breakage in the spinning and drawing processes. The size, etc., of the inorganic fine particles used in the present invention can be the same as those of inorganic fine particles that are generally added to and used in fibers.

Examples of a method of adding the inorganic fine particles include a method wherein a powder is directly added to the first component and the second component, or a method wherein a master batch is prepared and kneaded into the resin and the like. The resin used to prepare the master batch is most preferably the same resin as the resin of the first component and second component, but the present invention does not particularly limit this resin provided it satisfies the conditions of the present invention, and a resin different from the first component and second component may also be used.

The conjugate fiber of the present invention can be most suitably obtained, for example, by first obtaining undrawn fibers by melt spinning using the above first component and second component, imparting crimping thereto in a crimping process after partially oriented crystallization has progressed in the drawing process, and then performing a heat treatment of set duration at a specific temperature using a hot air dryer, etc.

The term "shrinkage ratio" as used in the present invention will now be explained. The compression resistance of a thermal bonded nonwoven fabric is determined by fiber properties such as fineness, cross-sectional shape, crimped form, etc., and by resin properties such as melting point, molecular weight, degree of crystallization, etc., of the thermoplastic resins constituting the conjugate fiber. However, it is often found that sufficient compression resistance is not obtained even if a thermal bonded nonwoven fabric is manufactured using a conjugate fiber that actually satisfies these properties.

As a result of various testing and verification, the inventors found that in the thermal bonding process performed to form the web comprising the fibers into a nonwoven fabric, the extent of crimping that can be expressed in the constituent fibers is a major factor affecting the compression resistance of the nonwoven fabric. The "shrinkage ratio" of a specific web produced from the thermal bonding conjugate fiber specified in the present invention described below is used as an index of compression resistance.

$$\text{shrinkage ratio}(\%)=\{(25\ (\text{cm})-h1\ (\text{cm}))/25\ (\text{cm})\}\times 100$$

(wherein h1 represents the shorter of either lengthwise dimension or crosswise dimension of the web after giving a heat treatment for 5 minutes to a 25 cm×25 cm web having a mass per unit area of 200 g/m$^2$).

The value of the web length after heating (h1) decreases as the crimping capability hidden in the fiber (latent crimpability) originating from the mode of conjugation, etc., is elicited by heating in the thermal bonding process when forming the nonwoven fabric increases. In other words, the value of the web length after heating (h1) decreases as the crimping hidden in the fiber, i.e., the capability that is then made apparent (expressed) by the thermal bonding process when forming the nonwoven fabric (expression of latent crimping) increases. When the relationship between the above measurement method and the compression resistance of actual nonwoven fabrics was investigated, it was found that if the shrinkage ratio calculated by the above formula after a heat treatment at 120° C. is 20% or greater, latent crimping is stably expressed at the time of thermal bonding during the process of manufacturing the nonwoven fabric, and a nonwoven fabric with excellent compression resistance can be obtained thereby. The nonwoven fabric will have an even greater expression of latent crimping when the shrinkage ratio is 30% or greater, preferably 40% or greater, and even more preferably 50% or greater. If the shrinkage ratio is 80% or less, loss of uniformity and width reduction of the nonwoven fabric will not occur, which is preferred. A shrinkage ratio of 60% or less is even more preferred.

To form a web by a carding process, etc., prior art methods attempted to obtain a very rigid fiber with excellent compression resistance, for example, by crimping the fibers beforehand to approximately 12 to 20 crimps/2.54 cm using a method such as a stuffing-box crimper roll, etc., and then allowing crystallization to proceed to a high degree by heating the fiber to a sufficiently high temperature (at most a temperature at least 5° C. lower than the melting point of the thermal bonding component). However, because oriented crystallization proceeded to a great extent with these methods, the expression of latent crimping in the thermal bonding process carried out to make the web comprising the fibers into a nonwoven fabric was reduced in those fibers, and it was difficult to impart compression resistance to the nonwoven fabric.

Conversely, if the heating temperature after crimping is lowered to increase the expression of latent crimping in the thermal bonding process carried out to make the web into a nonwoven fabric, the rigidity of the fibers decreases, and accordingly the compression resistance and bulkiness of the nonwoven fabric obtained using those fibers is lost. When the draw ratio is decreased as much as necessary to reduce oriented crystallization, fiber strength and rigidity decrease, and the compression resistance and bulkiness of the nonwoven fabric are lost in that case as well.

In manufacturing the conjugate fiber of the present invention, prior to forming the web, in the steps from drawing through crimping it is preferable to reduce oriented crystallization slightly and maintain fiber strength by heating the fibers to the point that latent crimping will not be expressed. By so doing it becomes possible to express the latent crimping sufficiently in the thermal bonding process for forming the nonwoven fabric and obtain a nonwoven fabric with excellent compression resistance and bulkiness. In manufacturing the conjugate fiber of the present invention, more specifically, in the steps from drawing to crimping it is preferable to establish a draw ratio of 65 to 85% of the break-draw ratio of the undrawn fibers, and to establish a heating temperature during drawing in a range between the glass transition temperature (Tg) of the first component plus 10° C. and the melting point of the second component minus 10° C.

The crimping in the fiber of the present invention can be made apparent before forming the web, but it need not be. Crimping imparted to the fiber before forming the web can be mechanical crimping, crimping formed by the partial expression of latent crimping with the condition that sufficient expression of latent crimping is retained in the thermal bonding process when forming the nonwoven fabric, or it can be a mixture of both. Zig-zag mechanical crimping can be noted as an example of a crimping configuration, and when carried out by a carding process, for example, a range of 12 to 20 crimps/2.54 cm is preferred.

After the above drawing through crimping processes, a heat treatment is carried out using a hot air dryer, etc., preferably at a temperature 20° C. to 40° C. lower, and more preferably 25° C. to 35° C. lower, than the melting point of the second component. For the heat treatment a publicly known means such as a hot air circulating dryer, hot air flow-through heat treatment apparatus, relaxing hot air dryer, hot plate compression bonding dryer, drum dryer, infrared dryer and the like can be used.

Thereafter the fibers can be cut into short fibers. The length of the short fibers is not particularly limited herein, but when a carding process is to be performed, a length of 20 to 102 mm is preferred, and a length of 30 to 51 mm is more preferred.

If the shrinkage ratio at 145° C. in the specified web manufactured from the thermal bonding conjugate fiber as measured by the above method is greater than the shrinkage ratio at 120° C., the shrinkage of the nonwoven fabric is likely to progress even after the fibers have been thermally bonded by heating in the thermal bonding process to form the nonwoven fabric and this leads to poor uniformity and width reduction in the nonwoven fabric. Therefore, it is preferable for relational expression [1] below to be established, and a range of 10 to 40% shrinkage ratio at 145° C. is preferred, but is not limited herein provided relational expression [1] is satisfied.

When the shrinkage ratio at 100° C. is greater than the shrinkage ratio at 120° C., thermal bonding between fibers will occur even after latent crimping has been fully expressed, and therefore the strength, softness, uniformity, and the like of the nonwoven fabric will become poorer. Therefore, it is preferable for relational expression [2] below to be established, and a range of 0 to 10% shrinkage ratio at 100° C. is preferred, but is not limited herein provided relational expression [2] is satisfied.

shrinkage ratio at 120° C.≥shrinkage ratio at 145° C. [1]

shrinkage ratio at 120° C.≥shrinkage ratio at 100° C. [2]

A cross-sectional fiber configuration wherein the core and the sheath have a different center of gravity such as an eccentric core-sheath type, eccentric hollow type, etc., can be noted for the present invention. Based on the spinnability and expression of latent crimping, an eccentricity ratio of 0.05 to 0.50 is preferred, and 0.15 to 0.30 is more preferred. In this case, the eccentricity ratio is expressed by the following formula published in Japanese Patent Application Publication No. 2006-97157.

Eccentricity ratio=$d/R$ (wherein d is the distance between the center point of the conjugate fiber and the center point of the first component constituting the core, and R is radius of the conjugate fiber).

Not only a circular cross-sectional shape but also a noncircular cross-sectional shape can be used for the cross-sectional shape of the core. Examples of noncircular cross-sectional shapes include star, elliptical, triangular, quadrangular, pentagonal, multilobe, array, T-shape, horseshoe shape and the like. Circular, semicircular, and elliptical cross-sectional core configurations are preferred from the standpoint of expression of latent crimping, and a circular shape is particularly preferred from the standpoint of strength of the nonwoven fabric.

In the fiber cross-section perpendicular to the lengthwise direction of the conjugate fiber of the present invention, a conjugate rate of the first component constituting the core and the second component constituting the sheath in the range of 10/90 vol % to 90/10 vol % is preferred, a conjugate rate of 30/70 vol % to 70/30 vol % is more preferred, and a conjugate rate of 40/60 vol % to 50/50 vol % is especially preferred. Establishing this range for the conjugate rate facilitates expression of the latent crimping by heat. In the explanation that follows, the conjugate rate is also expressed in units of vol %.

For the fineness of the conjugate fiber of the present invention 1.0 to 8.0 dtex is preferred, 1.7 to 6.0 dtex is more preferred, and 2.6 to 4.4 dtex is especially preferred. Establishing this range for the fineness enables both bulkiness and compression resistance to be obtained.

Blending the conjugate fiber of the present invention into a nonwoven fabric at a blend ratio in the range of 10 to 60 wt % is preferred, and a blend ratio of 15 to 40 wt % is even more preferred, because it enables bulkiness to be maintained under a light load and enhances compression resistance. Other fibers that can be included in the nonwoven fabric are not particularly limited herein, and examples include monofilaments of PET, PP, etc., and conjugate fibers of PET/PE and PP/PE. The use of a conjugate fiber as the other fiber is preferred from the standpoint of strength and bulkiness of the nonwoven fabric. From the standpoint of softness and uniformity, the shrinkage ratio of the other fiber is preferably less than 20%, and more preferably less than 10%, when measured under the same conditions used to determine the shrinkage ratio of the conjugate fiber of the present invention (i.e., the shrinkage ratio when a web of 25cm length×25 cm width with a mass per unit area of 200 g/m$^2$ is heat treated at 120° C. for 5 min).

The nonwoven fabric prepared using the conjugate fiber of the present invention can be used for various fiber products requiring bulkiness and compression resistance. Such fiber products include absorbent articles such as diapers, napkins, incontinence pads, etc.; medical hygiene supplies such as gowns, scrubs, etc.; interior furnishing materials such as wall coverings, Japanese translucent sliding window paper, floor coverings, etc.; daily living-related materials such as various covering cloths, cleaning wipes, garbage container coverings, etc.; toilet related products such as disposable toilets, toilet seat covers, etc.; pet products such as pet sheets, pet diapers, pet towels, etc.; industrial supplies such as wiping materials, filters, cushioning materials, oil adsorbents, ink tank adsorbents, etc.; general medical supplies; bedding materials; nursing care products, and so forth.

EXAMPLES

The present invention is described in greater detail below through examples, but the present invention is by no means limited thereto. The evaluations of properties in each example were preformed in accordance with the following methods.

Examples 1 to 17 and Comparative Examples 1 to 8

Conjugate fibers (Examples 1 to 7 and Comparative Examples 1 to 4) were manufactured under the conditions shown in Table 1 and nonwoven fabrics (Examples 8 to 17 and Comparative Examples 5 to 8) were obtained thereby. The performance was then evaluated and measured. The manufacturing conditions of the conjugate fibers and methods for measuring the properties thereof, and the manufacturing conditions of the nonwoven fabric and methods for measuring the properties thereof are explained below. Tables 1-1, 1-2 and 2 below show the combined evaluation results.

(Thermoplastic Resin)

The following resins were used as the thermoplastic resin constituting the fiber.

resin 1: High density polyethylene (abbreviated as PE) with a density of 0.96 g/cm$^3$, MFR (at 190° C. and a load of 21.18 N) of 16 g/10 min, and melting point of 130° C.

resin 2: Linear low-density polyethylene (abbreviated as L-LDPE) with a density of 0.94 g/cm$^3$, MFR (at 190° C. and a load of 21.18 N) of 20 g/10 min, and a melting point of 122° C.

resin 3: Polypropylene (abbreviated as PP-1) with an MFR (at 230° C. and a load of 21.18 N) of 7 g/10 min and a melting point of 162° C.

resin 4: Crystalline polypropylene (abbreviated as PP-2) with an MFR (at 230° C. and a load of 21.18 N) of 5 g/10 min and a melting point of 163° C.

resin 5: Crystalline polypropylene (abbreviated as PP-3) with an MFR (at 230° C. and a load of 21.18 N) of 16 g/10 min and a melting point of 162° C.

resin 6: Ethylene-propylene-1-butene tercopolymer containing 4.0 wt % ethylene and 2.65 wt % 1-butene (abbreviated as co-PP) with an MFR (at 230° C. and a load of 21.18 N) of 16 g/10 min, and melting point of 131° C.

resin 7: Polyethylene terephthalate (abbreviated as PET) with an intrinsic viscosity (η) of 0.64 and a glass transition temperature of 70° C.

(Melt Flow Rate (MFR) Measurement)

The melt flow rate of the above resins 1 to 6 was measured in accordance with JIS K 7210. The MI was measured in accordance with Condition D (test temperature of 190° C., load 2.16 kg) of Appendix A, Table 1, and the MFR was measured in accordance with Condition M (test temperature 230° C., load 2.16 kg).

(Manufacture of Conjugate Fiber)

Using the thermoplastic resins shown in Table 1 the first component was placed into the core side and the second component was placed into the sheath side. Inorganic fine particles were added by a method wherein master batches of titanium dioxide were prepared and kneaded into the first component and second component in the amounts shown in Table 1. Spinning was performed at the extrusion temperature, conjugate rate (vol %), and cross-sectional shape shown in Table 1. During that process a fiber treatment agent having a potassium alkyl phosphate as the main component thereof was placed in contact with the oiling roll and applied therefrom. The resulting undrawn fibers passed through the drawing through crimping processes under the conditions shown in Table 1 with the draw temperature (hot roll surface temperature) set to 90° C. Then a heat treatment step was carried out for 5 min at the heat treatment temperature shown in Table 1 using a hot air circulating dryer to obtain fibers. Crimping was then performed by a stuffing-box type crimp roll, and zig-zag machine crimps were imparted in the range of 12 to 20 crimps/2.54 cm.

The fibers were cut by a cutter into short fibers with the length (cut length) shown in Table 1, and those were used as test sample fibers. The obtained test sample fibers were made into a carded web with a mass per unit area of 200 g/m$^2$ using a roller carding test machine, and were used for the measurement of the shrinkage ratio.

(Method of Inorganic Fine Particle Addition)

Commercially available $TiO_2$ for fiber addition was used as the inorganic fine particles and was added to the above conjugate fibers. The following method was used for adding the inorganic fine particles to the fibers.

The particles were added to the first component and/or the second component by first preparing a master batch using a powder of inorganic fine particles. Resins used for making the master batches were the same resins used for the first and second components. The addition rate shown in Table 1 is expressed as "wt % in component 1/wt % in component 2."

(Shrinkage Ratio)

The test sample fibers were formed into a web using the roller carding test machine to prepare a web with a mass per unit area of 200 g/m$^2$. This web was cut into a square sheet of 25 cm length×25 cm width, and a heat treatment was performed thereon at 120° C. for 5 min using a commercial hot air circulating dryer.

When carded web had cooled after the heat treatment, the shorter of either the lengthwise or crosswise dimension of the web was measured at 3 locations (upper, center, and lower,along the direction) and the average value h1 (cm) was obtained. The shrinkage ratio was calculated from the following formula.

$$\text{shrinkage ratio}(\%)=\{(25\ (\text{cm})-h1\ (\text{cm}))/25\ (\text{cm})\}\times 100$$

(Fabrication of Nonwoven Fabric)

Test sample fibers A to K shown in Table 1 obtained by the above process steps were blended at the ratios (wt %) for raw stock 1 and raw stock 2 shown in Table 2. The fiber blend was carded into a web on a separate roller carding test machine, and that web was subjected to through-air (abbreviated as TA) processing at 130° C. with a suction dryer to obtain a nonwoven fabric.

A sensory evaluation of the consistency of the resulting nonwoven fabric was performed using the following four-step scale.

Good⊗>○>Δ>×Poor

⊗ . . . No unevenness (in mass per unit area) was seen.

○ . . . Slight unevenness (in mass per unit area) was seen.

Δ . . . Unevenness (in mass per unit area) was seen.

× . . . Unevenness (in mass per unit area) and width reduction of the nonwoven fabric were seen.

(Compression Test)

The nonwoven fabric resulting from the above process steps was cut into a 5 cm lengthwise×5 cm crosswise square, and four such squares of nonwoven fabric were overlapped. The squares were compressed at 0.05 cm/sec so that the compression load reached 70 gf/cm$^2$. The specific volume (cm$^3$/g) was calculated from the thickness values (mm) at 10 gf/cm$^2$ and at 70 gf/cm$^2$. Then the rate of compression was determined using the following formula.

The compression load was established at 10 gf/cm$^2$ and 70 gf/cm$^2$ because conditions in which the nonwoven fabric is used as a diaper or other hygiene product were assumed, and in particular 70 gf/cm$^2$ is the force resulting from sitting in a chair and on the floor.

It was judged that the compression resistance improved as the value of the compression rate decreased.

$$\text{Compression rate}(\%)=\{(X10-X70)/X10\}\times 100$$

Here X10 and X70 represent the following:

X10 is the specific volume (cm$^3$/g) at a load of 10 gf/cm$^2$; and

X70 is the specific volume (cm$^3$/g) at a load of 70 gf/cm$^2$.

TABLE 1-1

| | Title in Table 2 | Ex. 1 A | Ex. 2 B | Ex. 3 C | Ex. 4 D | Ex. 5 E | Ex. 6 F | Ex.7 G |
|---|---|---|---|---|---|---|---|---|
| 1st Component | Resin | PET | PET | PET | PET | PET | PET | PET |
| | Intrinsic viscosity (η) | 0.64 | 0.64 | 0.64 | 0.64 | 0.64 | 0.64 | 0.64 |
| | MFR (g/10 min) | — | — | — | — | — | — | — |
| | Melting point (° C.) | 255 | 255 | 255 | 255 | 255 | 255 | 255 |
| | Extrusion temp. (° C.) | 305 | 305 | 305 | 305 | 305 | 305 | 305 |
| 2nd component | Resin | PE | PE | PE | L-LDPE | L-LDPE | L-LDPE | PE |
| | MFR (g/10 min) | 16 | 16 | 16 | 20 | 20 | 20 | 16 |
| | Melting point (° C.) | 130 | 130 | 130 | 122 | 122 | 122 | 130 |
| | Extrusion temp. (° C.) | 230 | 230 | 230 | 230 | 230 | 230 | 230 |
| Mfg. cond. | Fineness (dtex) | 8 | 8 | 8.9 | 8.7 | 7 | 7 | 8.9 |
| | Draw ratio | 2.6 | 2.6 | 3.5 | 3.5 | 3.1 | 3 | 3.5 |
| | Heat treatment temp.(° C.) | 100 | 80 | 90 | 90 | 90 | 90 | 100 |

TABLE 1-1-continued

| | Title in Table 2 | Ex. 1 A | Ex. 2 B | Ex. 3 C | Ex. 4 D | Ex. 5 E | Ex. 6 F | Ex.7 G |
|---|---|---|---|---|---|---|---|---|
| Fiber properties | Mass corrected Fineness (dtex) | 3.9 | 3.3 | 2.8 | 2.8 | 2.3 | 2.4 | 2.8 |
| | Conjugate rate (1st/2nd) | 40/60 | 40/60 | 40/60 | 40/60 | 40/60 | 50/50 | 40/60 |
| | Additive | $TiO_2$ | $TiO_2$ | $TiO_2$ | $TiO_2$ | $TiO_2$ | $TiO_2$ | $TiO_2$ |
| | Addition rate (1st/2nd:%) | 2/3 | 2/3 | 2/3 | 2/3 | 2/3 | 2/3 | 0.4/0 |
| | Cross sectional shape | eccentric core-sheath | eccentric core-sheath | eccentric core-sheath | eccentric core-sheath | eccentric core-sheath | eccentric core-sheath | eccentric core-sheath, but close to side-by-side |
| | Cut length (mm) | 38 | 38 | 38 | 38 | 38 | 38 | 51 |
| | Shrinkage ratio at 145° C. (%) | 35 | 45 | 15 | 25 | 22 | 14 | 13 |
| | Shrinkage Ratio at 120° C. (%) | 57 | 59 | 20 | 30 | 25 | 21 | 32 |
| | Shrinkage Ratio at 100° C. (%) | 22 | 42 | 8 | 8 | 9 | 11 | 10 |

TABLE 1-2

| | Title in Table 2 | Comp. Ex. 1 H | Comp. Ex. 2 I | Comp. Ex. 3 J | Comp. Ex. 4 K |
|---|---|---|---|---|---|
| 1st component | Resin | PP-1 | PP-2 | PP-3 | PET |
| | Intrinsic viscosity (n) | — | — | — | 0.64 |
| MFR | (g/10 min) | 7 | 5 | 16 | — |
| | Melting point (° C.) | 162 | 163 | 162 | 255 |
| | Extrusion temp. (° C.) | 310 | 315 | 260 | 305 |
| 2nd component | Resin | Co-PP | PE | PE | PE |
| | MFR (g/10 min) | 16 | 16 | 16 | 16 |
| | Melting point (° C.) | 130 | 130 | 130 | 130 |
| | Extrusion temp. (° C.) | 210 | 240 | 240 | 230 |
| Mfg. cond. | Fineness (dtex) | 4.4 | 15.9 | 7.5 | 8.6 |
| | Draw ratio | 2.4 | 5 | 4 | 3.4 |
| | Heat treatment temp. (° C.) | 75 | — | 80 | 120 |
| Fiber properties | Mass corrected fineness (dtex) | 2.2 | 3.7 | 2.2 | 3.4 |
| | Conjugate rate (1st/2nd) | 50/50 | 50/50 | 50/50 | 40/60 |
| | Additive | — | $TiO_2$ | $TiO_2$ | $TiO_2$ |
| | Addition rate (1st/2nd %) | 0/0 | 0.4/0 | 0.4/0 | 2/3 |
| | Cross sectional shape | side-by-side | eccentric core-sheath | concentric core-sheath | eccentric core-sheath |
| | Cut length (mm) | 45 | 51 | 51 | 38 |
| | Shrinkage ratio at 145° C. (%) | 80 | 9 | 0.2 | 0 |
| | Shrinkage ratio at 120° C. (%) | 69 | 14 | 0.1 | 8.8 |
| | Shrinkage ratio at 100° C. (%) | 50 | 6 | 0 | 8.5 |

TABLE 2

| | Raw stock 1 | Raw stock 2 | Blend ratio (%) Raw stock 1 | Blend ratio (%) Raw stock 2 | Mass/unit area of 1 sheet of nonwoven fabric ($g/m^2$) | Uniformity | 10 $gf/cm^2$ load Thickness (mm) | 10 $gf/cm^2$ load Specific volume ($cm^3/g$) | 70 $gf/cm^2$ load Thickness (mm) | 70 $gf/cm^2$ load Specific volume ($cm^3/g$) | Compression ratio (%) |
|---|---|---|---|---|---|---|---|---|---|---|---|
| Ex. 8 | A | K | 15 | 85 | 23.1 | ○ | 7.0 | 75.8 | 2.1 | 22.9 | 69.8 |
| Ex. 9 | A | K | 30 | 70 | 28.1 | ○ | 8.4 | 74.2 | 3.3 | 29.2 | 60.6 |
| Ex. 10 | A | K | 50 | 50 | 27.1 | Δ | 7.3 | 67.3 | 3.1 | 28.6 | 57.5 |
| Ex. 11 | B | K | 15 | 85 | 26.2 | Δ | 8.2 | 78.2 | 2.7 | 25.8 | 67.0 |
| Ex. 12 | C | K | 15 | 85 | 24.2 | ○ | 7.3 | 75.4 | 2.1 | 21.7 | 71.2 |
| Ex. 13 | D | K | 15 | 85 | 20.3 | ○ | 6.4 | 78.9 | 1.8 | 22.2 | 71.9 |
| Ex. 14 | E | K | 15 | 85 | 20.2 | ○ | 6.3 | 78.0 | 1.7 | 21.0 | 73.1 |
| Ex. 15 | F | K | 15 | 85 | 21.0 | ○ | 6.4 | 76.2 | 1.8 | 21.4 | 71.9 |
| Ex. 16 | G | K | 15 | 85 | 22.4 | ○ | 7.1 | 79.2 | 2.0 | 22.3 | 71.8 |
| Ex. 17 | A | J | 15 | 85 | 25.5 | ○ | 5.9 | 58.1 | 2.4 | 23.1 | 60.2 |
| Comp. Ex. 5 | — | K | 0 | 100 | 23.5 | Ⓧ | 7.2 | 76.6 | 1.9 | 19.7 | 74.3 |
| Comp. Ex. 6 | H | K | 15 | 85 | 22.1 | X | 6.1 | 68.4 | 1.8 | 20.2 | 70.5 |
| Comp. Ex. 7 | I | K | 15 | 85 | 22.5 | ○ | 7.4 | 82.0 | 1.8 | 19.9 | 75.7 |
| Comp. Ex. 8 | — | J | 0 | 100 | 22.1 | Ⓧ | 5 | 56.3 | 1.5 | 16.7 | 70.3 |

INDUSTRIAL APPLICABILITY

Because a post-heat treatment shrinkage ratio of at least 20% is retained in the conjugate fiber of the present invention, it is possible to manufacture a nonwoven fabric that expresses latent crimping during thermal bonding in the process of forming the nonwoven fabric, and has excellent bulkiness and compression resistance. Additionally, because inorganic fine particles are added to the conjugate fiber, a nonwoven fabric providing bulkiness, compression resistance, and softness simultaneously can be obtained, and a heretofore unpredictable excellent advantageous effect is provided from the intrinsic effect of the addition of inorganic fine particles.

A nonwoven fabric formed from the conjugate fiber of the present invention has excellent bulkiness, compression resistance and softness, and suitable uses requiring such bulkiness, compression resistance, and softness include absorbent articles such as diapers, napkins, incontinence pads, etc.; medical hygiene supplies such as gowns, scrubs, etc.; interior furnishing materials such as wall coverings, Japanese translucent sliding window paper, floor coverings, etc.; daily living-related materials such as various covering cloths, cleaning wipes, garbage container covers, etc.; disposable toilets; toiletry products such as toilet seat covers, etc.; pet products such as pet sheets, pet diapers, pet towels, etc.; industrial supplies such as wiping materials, filters, cushioning materials, oil adsorbents, ink tank adsorbents, etc.; general medical supplies; bedding materials; nursing care products, and so forth, all of which require bulkiness, compression resistance, and softness.

The invention claimed is:

1. A thermal bonding conjugate fiber with thermal shrinkage properties, wherein the thermal bonding conjugate fiber has an eccentric core-sheath structure in which a first component comprising a polyester resin constitutes a core and a second component comprising a polyolefin resin having a melting point at least 15° C. lower than a melting point of the polyester resin constitutes a sheath, wherein the thermal bonding conjugate fiber comprises inorganic fine particles in an amount in a range from 1 to 5 wt %, the thermal bonding conjugate fiber has an eccentricity ratio in a range of 0.15 or more and lower than 0.19, and wherein a shrinkage ratio of the thermal bonding conjugate fiber after a heat treatment at 120° C. is at least 20%, a shrinkage ratio at 100° C. is in a range from 0 to 9%, and a shrinkage ratio after a heat treatment at 100° C., 120° C., or 145° C. satisfies following formulae (1) and (2):

$$\text{shrinkage ratio at } 120^\circ\text{ C.} \geq \text{shrinkage ratio at } 145^\circ\text{ C.; and} \quad (1)$$

$$\text{shrinkage ratio at } 120^\circ\text{ C.} \geq \text{shrinkage ratio at } 100^\circ\text{ C.,} \quad (2)$$

wherein the shrinkage ratio is calculated by a following measurement method:

$$\text{shrinkage ratio (\%)} = \{25\text{ (cm)} - h1\text{ (cm)})/25\text{ (cm)}\} \times 100\text{, and}$$

wherein h1 represents a shorter dimension of a lengthwise dimension and a crosswise dimension of a web formed of the thermal bonding conjugate fiber after giving a heat treatment for 5 minutes to a 25 cm×25 cm web having a mass per unit area of 200 g/m$^2$.

2. The thermal bonding conjugate fiber according to claim 1, wherein a fineness of the thermal bonding conjugate fiber is from 1.0 to 8.0 dtex.

3. A nonwoven fabric, in which the thermal bonding conjugate fiber according to claim 1 is blended with one or more types of different thermal bonding fibers, wherein the thermal bonding conjugate fiber is contained therein at a blend ratio of 10 to 60 wt %.

4. The thermal bonding conjugate fiber according to claim 1, wherein the inorganic fine particles are at least one material selected from the group consisting of titanium oxide, zinc oxide, barium titanate, barium carbonate, barium sulfate, zirconium oxide, zirconium silicate, alumina, and magnesium oxide.

5. The thermal bonding conjugate fiber according to claim 4, wherein the inorganic fine particles include titanium dioxide.

* * * * *